US006230647B1

(12) United States Patent
Donoian

(10) Patent No.: US 6,230,647 B1
(45) Date of Patent: May 15, 2001

(54) RADAR UNIT MOUNTING SYSTEM FOR A SAILBOAT

(76) Inventor: Michael W. Donoian, P.O. Box 791, Bellingham, WA (US) 98227

( * ) Notice: Subject to any disclaimer, the term of this patent is extended or adjusted under 35 U.S.C. 154(b) by 0 days.

(21) Appl. No.: 09/375,176

(22) Filed: Aug. 16, 1999

Related U.S. Application Data

(60) Provisional application No. 60/096,633, filed on Aug. 14, 1998.

(51) Int. Cl.[7] ..... B63B 8/00
(52) U.S. Cl. ..... 114/343
(58) Field of Search ..... 114/343, 364, 114/39.21, 90; 248/230, 218.4; 343/709

(56) References Cited

U.S. PATENT DOCUMENTS 4,224,890 * 9/1980 Johnson, Jr. ..... 114/109
4,694,769 * 9/1987 Sowers ..... 114/90
5,111,212 * 5/1992 DeSatnick et al. ..... 342/709
5,154,386 * 10/1992 Heck ..... 248/230
5,489,911 * 2/1996 Gordon et al. ..... 343/709
6,097,344 * 8/2000 Anderson ..... 343/709

OTHER PUBLICATIONS

Schaefer, Triangle Plates. West Marine Catalog, p. 796, Jan. 1999.*
Waltz, Radar Leveling System. West Marine Catalog, p. 97, Jan. 1999.*

* cited by examiner

*Primary Examiner*—S. Joseph Morano
*Assistant Examiner*—Ajay Vasudeva
(74) *Attorney, Agent, or Firm*—Robert B. Hughes; Hughes & Schacht, PLLC

(57) ABSTRACT

A mounting apparatus for a radar unit by which the unit is mounted to the three ropes of a backstay of a yacht. There is a mounting plate having three connecting openings which connect to the free ends of a main line from the mast and two bow lines. The lines are tensioned to hold the mounting plate in a position above the deck. A mounting platform is connected by a rotary connection to the back plate, and the radar unit (by the force of gravity) remains level.

19 Claims, 5 Drawing Sheets

RADAR UNIT MOUNTING SYSTEM FOR A SAILBOAT

This application claims benefit of Provisional Application Ser. No. 60/096,633 filed Aug. 14, 1998.

BACKGROUND OF THE INVENTION

1. Field of the Invention

The present invention relates to a system, apparatus and method for mounting equipment, such as radar unit, to a sailboat or the like. More particularly, the present invention is adapted to effectively utilizing the existing rigging in a sailboat for mounting such equipment.

2. Background Art

In recent years, boats of various kinds have been equipped with a variety of electronic equipment, and some of this equipment, such as transmitters, those having antennas, reflectors, radar units, etc. have particular requirements with regard to positioning and/or location of the same. Radar units have become less expensive and are now found in fairly large number of boats. Desirably, the radar unit should be mounted at a higher location in order to obtain a good range. Further, it's desirable that the radar unit should maintain a desired orientation regardless of the heeling or rolling motion of the boat.

Accordingly, in recent years, there have become a number of designs available for mounting radar units, antennas, and other equipment to the boat, and a number of these have appeared in patent literature:

U.S. Pat. No. 5,111,212 (DeSatnick et al.) discloses a device to mount a radar antennae to a sailboat. There is a bracket assembly that comprises a tube 39 which fits around the lower portion of the backstay 17. The lower end of the tube 39 and the bracket assembly 37 are prevented from rotating around the stay 17. Then the mounting assembly for the radar unit is mounted to the tube 39. The patent is directed mainly toward a device by which the radar antennae is mounted so that the radar unit remains level when the sailboat is heeling. The bracket provides a horizontal axis of rotation about which the unit is mounted so that the center of gravity is below the axis of rotation. Also, viscous fluid is provided in the device to dampen oscillations.

U.S. Pat. No. 4,659,044 (Armstrong) shows a bracket secured to a mast or spar for holding a radar antenna in place.

U.S. Pat. No. 4,453,482 (Barker) shows a mast for mounting a radar antenna on the upper deck of a ship. This mast 10 is arranged so that it is hinge mounted to the deck. There is a spring mechanism utilizing an elastomeric material which urges the mast 10 toward an upright position. As shown in FIG. 1, in the upright position, it is held in place by a couple of cables 12. When it is desired to take the radar unit down, the mast is lowered so that it lays flat on the deck.

A fourth patent was also developed in this search, U.S. Pat. No. 3,145,385 (Jenkins). This shows an antennae that is used in radio communication. There are three flexible guy wires 24, 25 and 26 that connect to the perimeter of the dish and also connect at the forward end of the elongated hollow metal wave guide 14. This is to provide an example of the general principal of locating a member by plurality of tension members attached to an object and anchored at angularly spaced locations.

SUMMARY OF THE INVENTION

The system, apparatus and method of the present invention was originated to provide an effective, user-friendly and economical way of mounting equipment, and more particularly electronic equipment such as a radar unit, in a boat or the like. More particularly the present invention was designed to be used in a sailboat or the like so that the existing rigging of the sailboat can be effectively utilized in the system.

In this system, there is a line connecting portion comprising first, second and third connecting lines, each having a first end which is connected to a respective one of three base connecting locations which are spaced from one another in a triangular configuration.

Also, there is a mounting assembly comprising a connecting section that comprises first, second and third connecting portions at first, second and third mounting locations, which are spaced from one another in a triangular configuration. The second ends of the first, second and third lines are connected to, respectively, the first, second and third connecting portions, in a manner that the three lines are in tension so as to locate the mounting assembly at a mounting location.

There is an equipment mounting section adapted to have equipment mounted thereto.

In a preferred form, the connecting section comprises an interconnecting portion by which the connecting section connects to the equipment mounting section in a manner to allow at least limited relative rotational movement between the connecting section and the equipment mounting section. Thus, the mounting section can remain in a desired angular position, so that the equipment mounted to the equipment mounting section would be properly positioned.

More specifically, the interconnecting section rotates about an axis having a substantial horizontal alignment component. The equipment mounting portion is located, relative to location of the interconnecting portion, so that equipment on the equipment mounting section is located sufficiently below the axis of rotation so that force of gravity tends to move the equipment mounting section to a location to maintain the desired position.

In the preferred configuration, the system is mounted to a boat, and the first line extends from an upper location on the boat downwardly toward a lower location of the boat. The connecting section connects to a lower end of the first line. The second and third lines are attached by upper ends thereof to the connecting section and connect at laterally spaced locations at the lower location of the boat. In a preferred embodiment shown herein, the first, second and third connecting lines comprise a backstay of a sailboat, and the first line connects to a mast to the sailboat. The first ends of the second and third lines are, in the preferred form, each connected to a tensioning member by which the second and third lines can be tensioned to be made taut.

The interconnecting portion comprises a first positioning member having a fixed angular orientation relative to the connecting section and a second positioning member having a fixed angular orientation relative to the equipment mounting section. The first and second positioning members are in operative engagement to move relative to one another so as to have a fixed angular orientation relative to one another as the equipment mounting section rotates relative to the connecting section. Thus, the proper angular orientation of the equipment mounting section is being maintained. In a preferred form, the first positioning member has a flat planar surface engaging bearing members of the connection portion to maintain the proper angular orientation. Also, there is a tightening device to put relatively rotating parts of the connection section in greater or lesser frictional engagement to control rotational movement of the mounting section.

In the method of the present invention the first, second and third connecting lines are provided, each connected to the base locations. The connecting section is connected to a mounting section to which equipment is mounted. Then the second ends of the first, second and third lines are connected to the connecting section in the manner described above.

The present invention is also directed to the mounting apparatus itself as it is used in being connected to the first, second and third, as described above. The structure for the construction and features of the apparatus are apparent from the above description.

Other features of the present invention will be apparent from the following detailed description.

DESCRIPTION OF THE PREFERRED EMBODIMENTS

Figure 1:
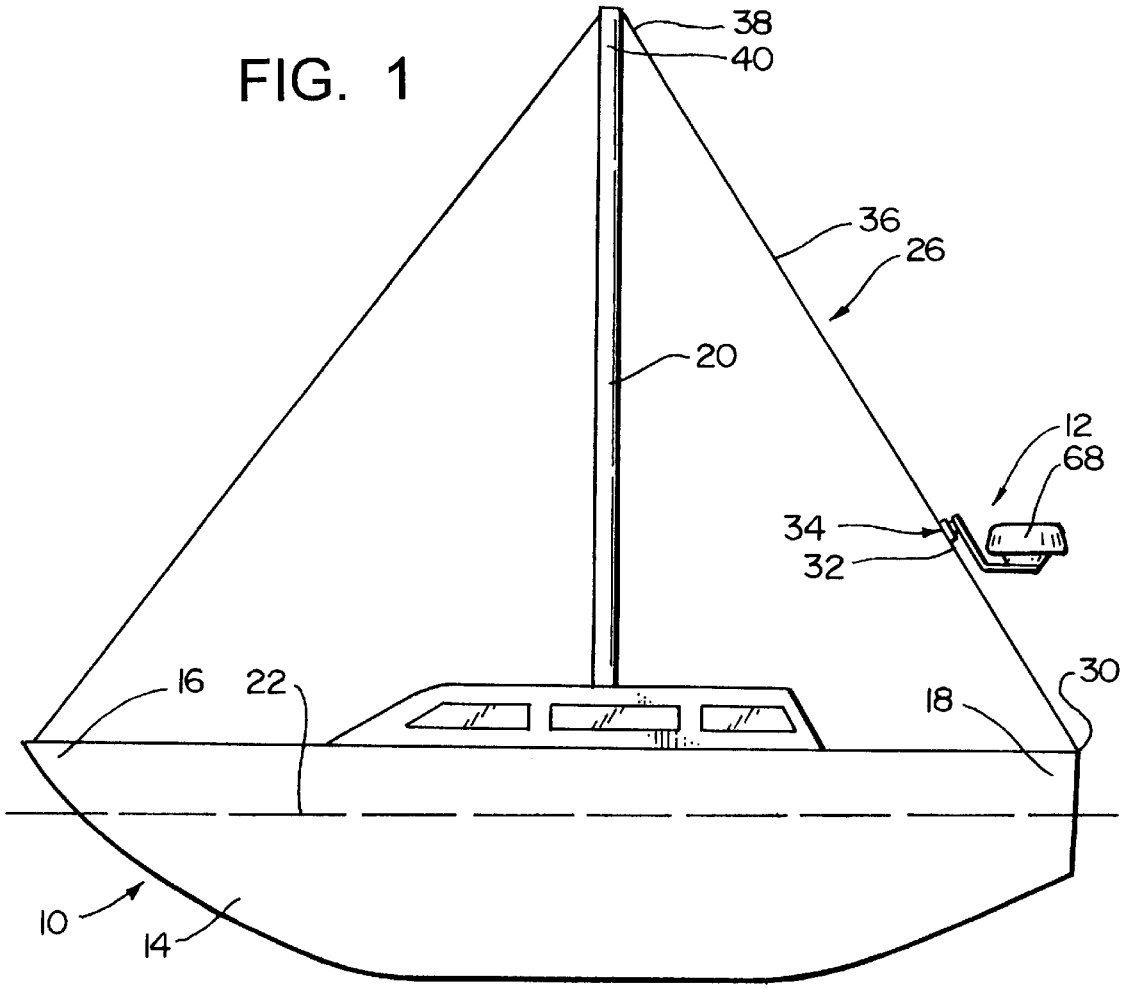
FIG. 1 is a side elevational view of a sailboat incorporating the present invention.
Figure 2:
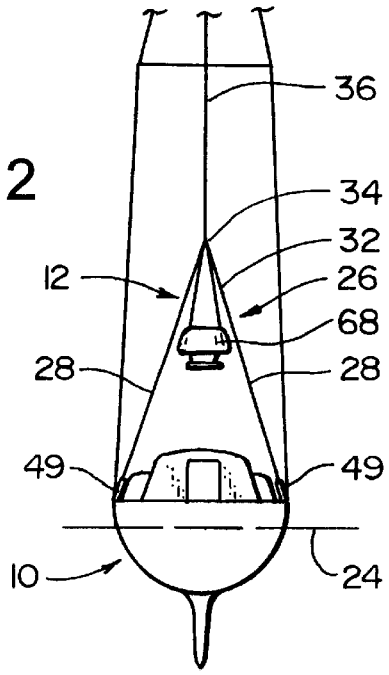
FIG. 2 is a rear view sailboat shown in FIG. 1, incorporating the present invention.
Figure 3:
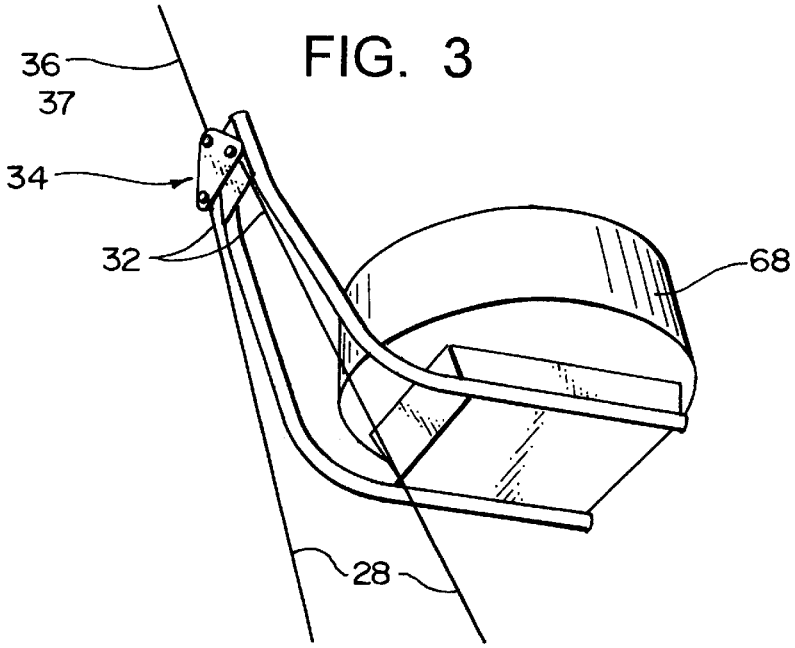
FIG. 3 is an isometric view showing the present invention installed on the sailboat shown in FIG. 1 and FIG. 2.

With reference to FIGS. 1 and 2, there is shown a sailboat 10 on which a first embodiment of the radar mounting apparatus 12 of the present invention is mounted. This boat comprises a hull 14 having a bow 16, a stem 18, and a main mast 20. For purposes of description, the boat 10 will be considered as having a forward to rear longitudinal axis 22 and a horizontal transverse axis 24.

In many sailboats, the rigging at the aft end of the boat comprises what is called a backstay (generally designated 26). This backstay 26 comprises a pair of lower lines 28 which connect at their lower ends 30 to the rear side connecting locations 30 on the hull 14. The upper end portions 32 of the lines 28 connect at a juncture location 34 to a single upper line 36 which extends from its lower connecting end upwardly and forwardly on a slant to connect at 38 to an upper end portion 40 of the mast 20.

This first embodiment of the present invention is incorporated as part of this backstay 26 in a rather unique manner to mount the radar mounting apparatus 12. The mounting apparatus 12 comprises a connecting portion 41 which in turn comprises a rigging plate 42 which has the overall configuration of an isosceles triangle having the apex 44 of the equal sides at an upper central location and the two lower juncture points 46 at laterally spaced locations. The rigging plate 42 has three connecting portions in the form of line connecting through openings, namely the upper apex opening 46 and the two lower side openings 48. The apex opening 46 connects to the lower end of the upper line 36, and the two side openings 48 connect, respectively, to the two upper end 32 of the lines 28.

The lower lines 28 are normally connected to the hull 14 by means of a turn buckle or some other tightening device, indicated schematically at 49, so that the proper tension is applied to the lines 28 and 36. It can readily be recognized that with the 28 and 36 in tension, the rigging plate 42 is pulled by these lines 28 and 36 to maintain the rigging plate 42 in an upwardly and forwardly slanting plane which is defined by, and occupied by, the lines 36 and 28.

The mounting apparatus 12 further comprises a mounting structure 50 and an interconnecting portion 52 by which the mounting structure 50 is connected to the rigging plate 42, and which can be considered as part of the connecting portion 41. The interconnecting portion 52 is arranged so that the mounting structure 50 is able to rotate along an axis of rotation (indicated at 54 in FIG. 4) that is substantially perpendicular to the plane occupied by the rigging plate 42.

The mounting structure 50 comprises a pair of laterally spaced arms 56, each arm 56 having a lower horizontally aligned portion 58, an upwardly and forwardly slanting intermediate portion 60 and an upper end connecting portion 62. Extending between the two horizontal arm portions 58 is a mounting platform 64 which connects along its side edges to the arm portions 58. This platform 64 is provided with a number of openings 66 arranged to connect to the radar unit 68. The radar unit 68 would normally be a commercially available radar unit, and the platform 64 and the openings or other attaching means 66 would be provided in the manner to make the connection to the radar unit 68 selected.

Figure 4:
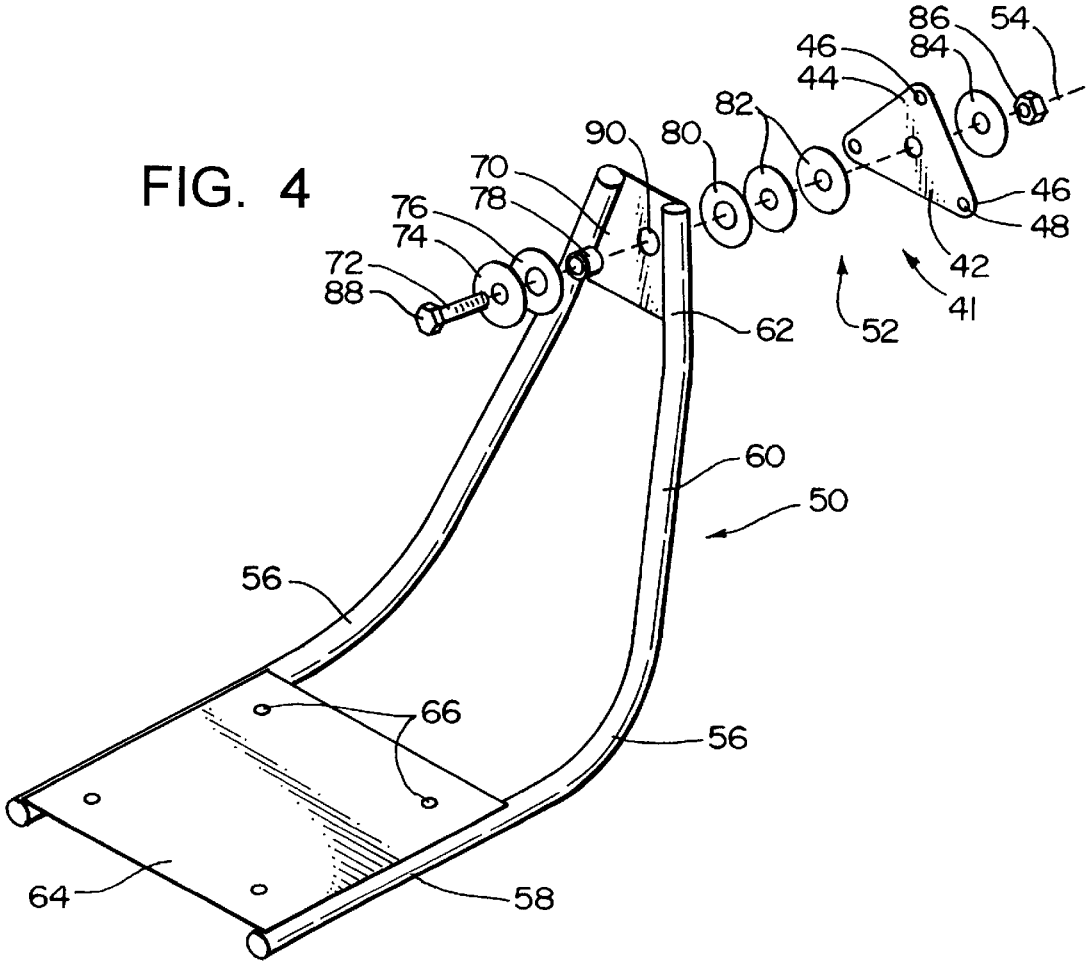
FIG. 4 is an isometric view showing the mounting assembly of the first embodiment of the present invention, with some of the components being spaced from one another for purposes of illustration.
Figure 5:
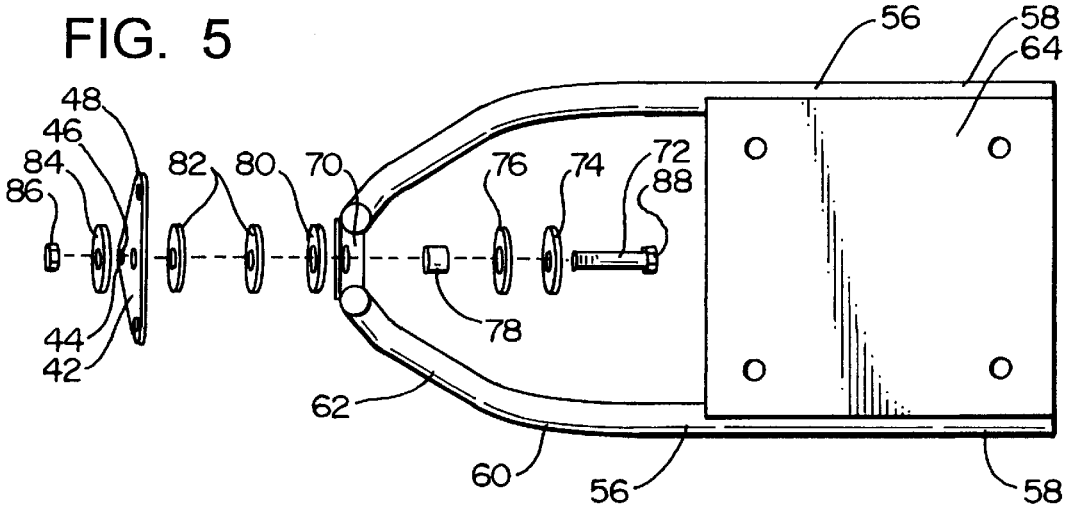
FIG. 5 is a top plan view of the mounting assembly, again showing certain components spaced from one another, as in FIG. 4.
Figure 6:
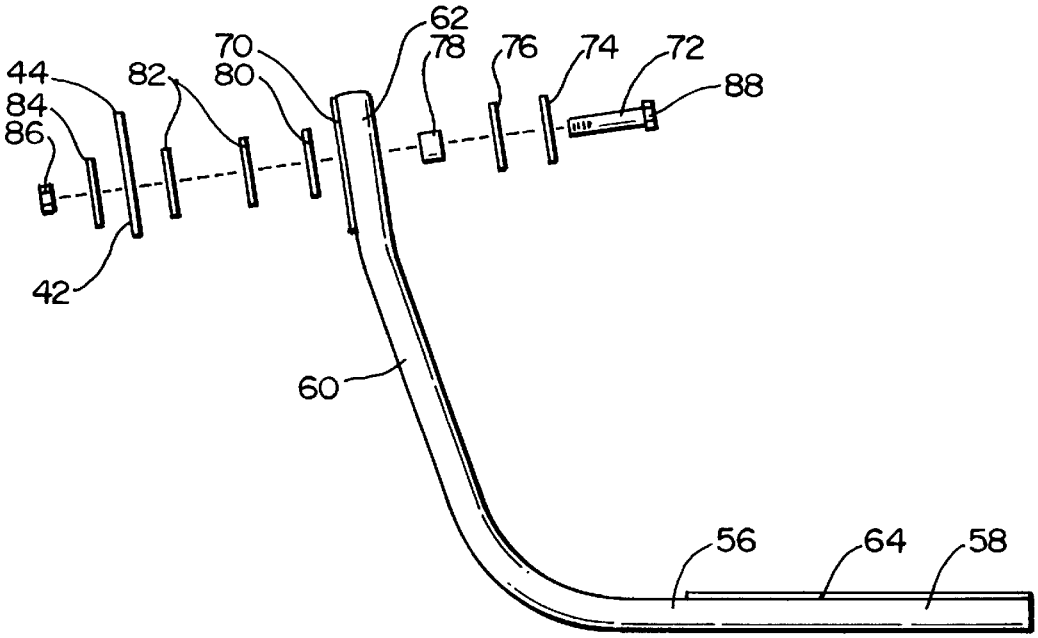
FIG. 6 is a side elevational view of the mounting assembly, as shown in FIGS. 4 and 5, with certain components spaced from one another.

There is an aligning and connecting plate 70 which is connected by its edge portions to the end connecting portion 62 of the two arm 56. This plate 70 is connected to the rigging plate 42 by means of the aforementioned interconnecting portion 52. With reference to FIG. 4, the interconnecting portion 52 comprises the plate 70, a bolt 72, a metal washer 74, a plastic washer 76, a spacer (bushing) 78, a plastic washer 80, two more metal washers 82 which act as spacers, another metal washer 84 positioned behind the rigging plate 42, and finally a nut 86. These components 72–86 are joined to one another in the arrangement indicated in FIG. 4. Thus, it can be seen that the two plastic washers are positioned on opposite sides of the connecting plate 70. When the bolt 72 is tightened by the nut 86, the head 88 of the bolt presses against the metal washer 74 and the plastic washer 76, and the plastic washer 76 in turn presses against the plate 70. The spacer fits in through opening 90 in the plate 70 and the bolt 72 extends through this spacer and the opening 90. When the nut 86 is tightened to press the washer 76 against the plate 70, the plastic washer 80 presses against the backside of the connecting plate 70. The washers 76 and 80 are both of a low friction material (i.e. Delron), and the bearing pressure caused by tightening the nut is selected so that as the boat rocks from side to side, the force of gravity acting on the radar unit 68 and the apparatus 12 will cause the radar unit 68 and the apparatus 12 to be positioned so that the radar unit 68 is substantially horizontal at all times.

To describe the manner in which the mounting apparatus 12 is installed, one convenient way of accomplishing this is as follows. First, the lower ends of the two lower lines 28 are loosened from their anchoring locations at 49, and the lower end of the upper line 36 is moved to a more forward location where it is closer to the deck. Then the lower end of the upper line 36 is connected through the apex opening 46 to the apex portion 44 of the rigging plate 42, and the upper ends of the two lower lines are connected to the lower rigging plate openings 48.

At that time the radar mounting apparatus 12 with the radar unit 68 mounted thereto is generally already connected to the rigging plate 42 by assembling the components of the interconnecting portion 52, as shown in FIG. 4.

Then the two lower lines 28 are pulled rearwardly and the lower end portions of the two lines 28 are connected to the turn buckles or other connecting/tightening devices indicated schematically at 49, on opposite sides of the stem. The turn buckle or other tightening means are operated to place the proper tension on the lower lines or cables 28 so that these have a sufficient tension load place thereon so as to properly position the mounting structure 50 with the radar unit 68 mounted thereto.

The nut 86 is adjusted so that the force exerted by the interconnecting assembly 52 is sufficient to maintain the mounting structure 50 and the radar unit 68 properly positioned, and yet is not so tight so that the mounting structure 50 is unable to rotate about the longitudinal axis 54 of the interconnecting portion 52. Thus, when the boat is subjected to rocking back and forth or is placed in a heeling position, the mounting structure 50 with the radar unit will (by the force of gravity) remain in a substantially horizontal position.

It is apparent that the three end connecting locations (i.e. the two lower end connecting locations at 30 and the connection of the upper line 36 at 38 to the end portion 40 of the mast 20) are in a triangular configuration (i.e. not in a straight line), and this particular configuration is the configuration of an isosceles triangle.

Likewise, the connecting locations at the apex opening 46 in the two lower side openings 48 of the rigging plate 42 are in a triangular configuration (i.e. not in a straight line). Thus, as tension is applied through the two lower lines 28, which in turn tensions the line 36, the rigging plate 42 becomes positioned at a location within the triangle defined by the anchoring locations 30 and 38, and the plane defined by the three connecting locations 48 and 46 and rigging plate 42 lie generally in a plane defined by the connecting locations 30 and 38. However, there is some departure from being positioned in this plane, because of the weight of the radar unit 68 and the mounting apparatus 12. However, this can be compensated for in the design of the mounting structure by anticipating the amount of deviation that would normally be expected.

As indicated previously, the interconnecting portion 52 is arranged so as to rotate along a longitudinal axis 54 which is coincident with the center line of the boat 72. Also, as indicated previously, the nut 86 is tightened to position the connecting plate (that is rigidly attached to the arms 56 of the mounting structure 50) in alignment with the rigging plate 42 so that the mounting structure 50 remains in the proper angular position relative to the plane occupied by the rigging plate 42. Thus, as the boat rolls from one side to another or is in a heeling position, the radar unit 68 can remain properly aligned with the horizontal, by having limited rotational movement relative to the rigging plate 42.

To describe the second embodiment of the present invention, reference will now be made to FIGS. 7 through 11. This second embodiment was designed to mount the radar unit to a sailboat which has a single line extending from the mast to the aft part of the boat. In this second embodiment, there is a mounting structure and a connecting means which are substantially the same as the mounting structure 50 and connecting means 52 of the first embodiment.

Accordingly, the mounting structure and connecting means of this second embodiment will not be described in detail, and will simply be giving numerical designations **50*a* and 52*a*** to distinguish them from the corresponding components of the first embodiment.

Figure 7:
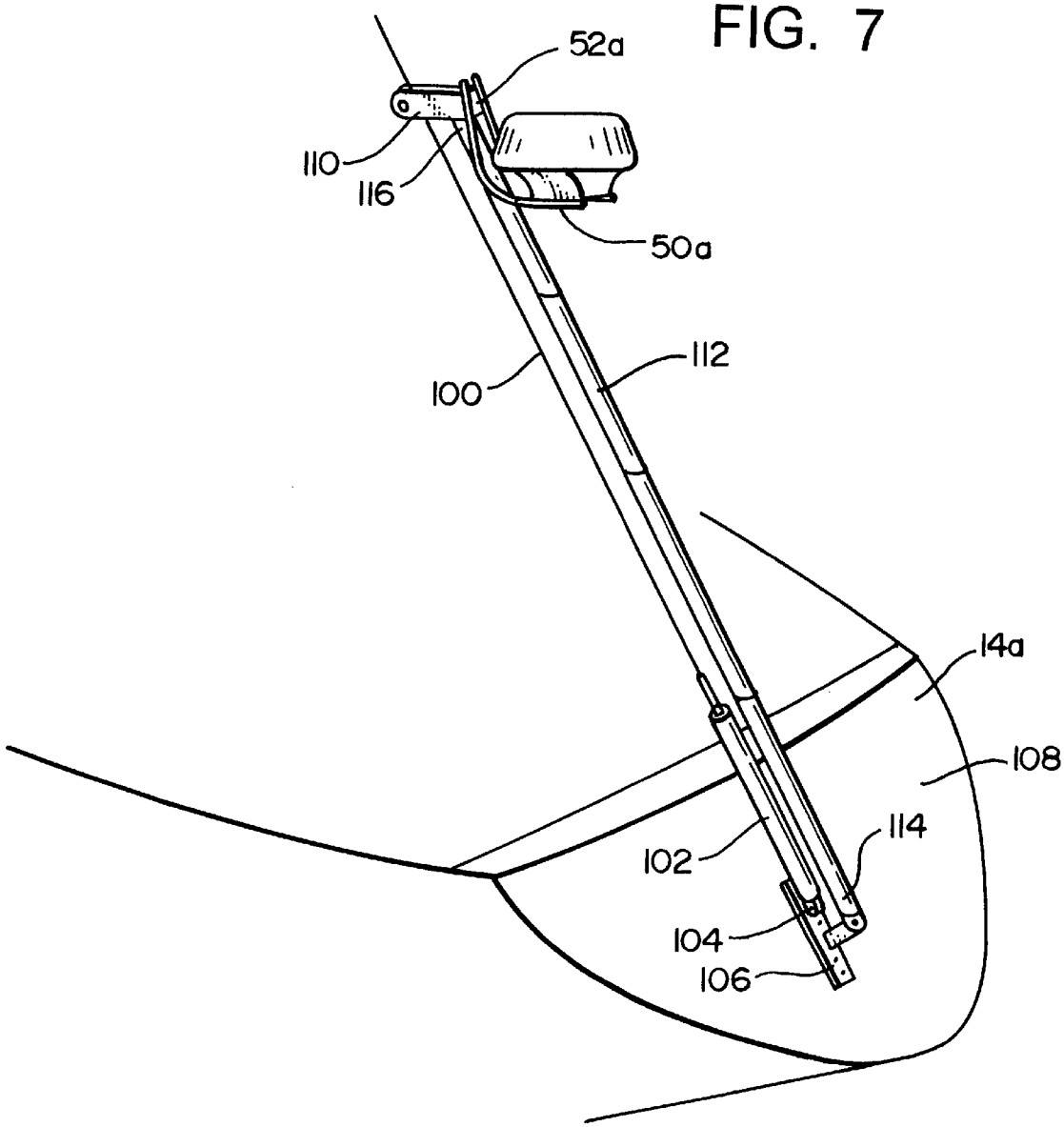
FIG. 7 is an isometric view showing a second embodiment of the present invention.
Figure 8:
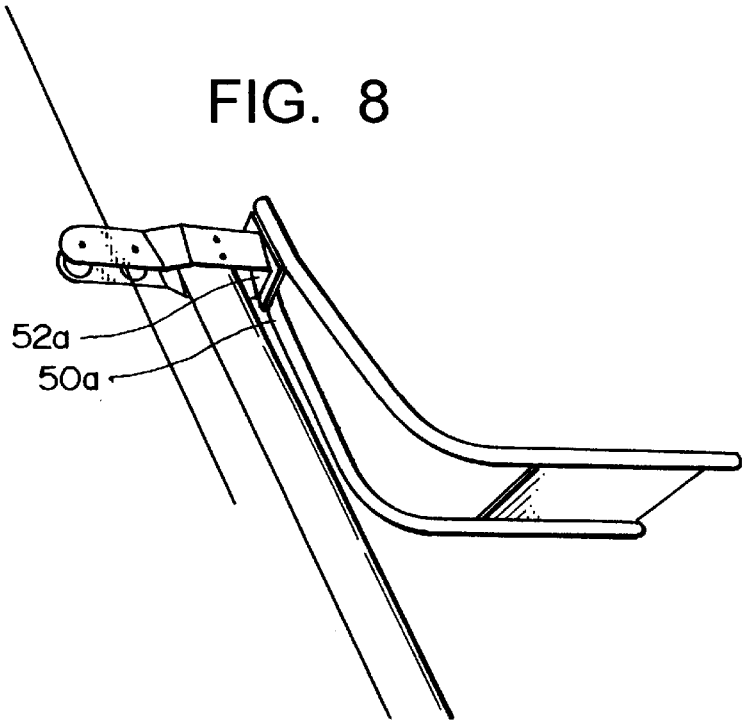
FIG. 8 is an isometric view of the second embodiment.

With reference to FIG. 7, it can be seen that the rigging at the aft end of the hull **14*a* is such that there is a single line 100 which is connected to a hydraulic tensioning member 102 that is in turn is connected through a pivot connection 104 to a bracket 106 that is fixedly connected to the back surface 108 to the hull 14*a*. This line extends upwardly and forwardly to connect to the mast in somewhat the same manner as the line 36** of the boat shown in the first embodiment.

In this second embodiment, there is not a rigging plate, such as the rigging plate 42 of the first embodiment. Rather, there is a mounting device 110 which is connected to the line 100, and is also connected to, and supported by, a pole 112 which is connected at its lower end 114 to the aforementioned bracket 106 and connects at its upper end 116 to the connecting device 110.

The pole 112 is desirably made up of several sections 116 connected together by a conventional fitting such as shown at 118. This particular fitting comprises upper and lower plug members 120 which fit inside the adjacent ends of the two adjacent sections 116 and an intermediate flange or collar section 122 which bears against adjacent edges of the pole sections 116.

Figure 11:
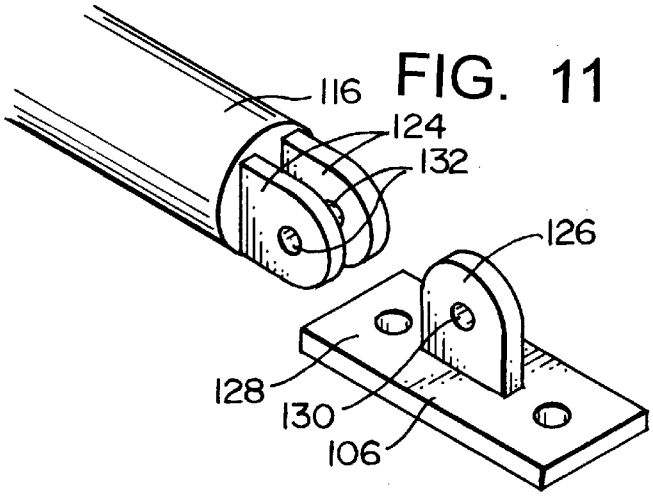
FIG. 11 is an isometric view of the attachment by which the mounting pole is connected to the stern of the boat.

As shown in FIG. 11, the bottom pole section 116 has a hinge connection to the aforementioned mounting bracket 106. The bottom pole section has a pair of ears 124 which fit on opposite sides of an upstanding member 126 mounted to a base 128 that is in turn bolted or otherwise fixedly connected to the hull **14*a*. Two protruding members 130 on the member 126 fit in matching holes 132 in the ears 124** to provide the hinge connection.

Figure 10:
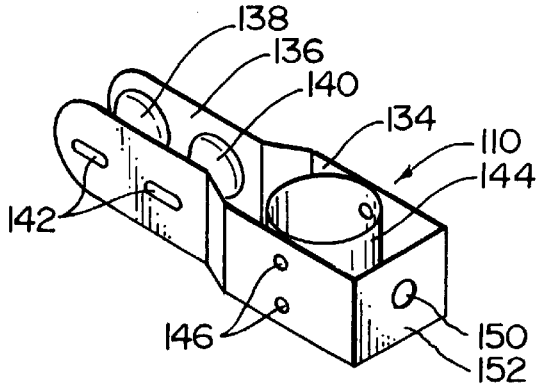
FIG. 10 is an isometric view of a mounting attachment by which the mounting structure is supported.
Figure 9:
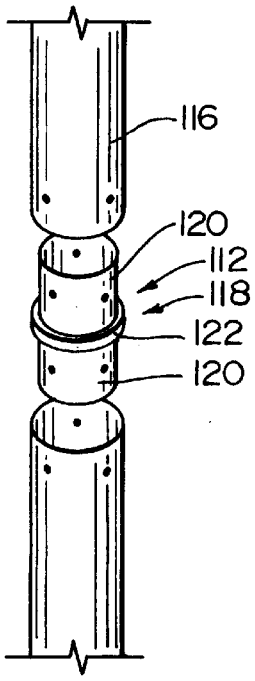
FIG. 9 is a view of a portion of the mounting pole of the second embodiment.

The aforementioned connecting device 110 is best shown in FIG. 10. This device 110 has a pole connecting portion 134 and line connection portion 136. The rope connection portion 136 comprises forward and rear pulley type rollers 138 and 140, each of which has a circumferential middle portion of reduced diameter to form a circumferential groove so that these pulley-like rollers 138 and 140 reliably contain the line 110 therebetween. Both of these pulley-like rollers 138 and 140 have a slot like mounting at 142 so that these can be adjusted fore and aft so that the pulley-like rollers 138 and 140 can be positioned to snugly engage the line 100.

The pole connecting portion 134 of the mounting device 110 has a box-like configuration, and there is provided a generally vertically aligned cylindrical socket or recess 144 which receives the upper end of the pole 112. The sides of pole mounting portion 134 have aligned upper transverse through opening 146, and when the upper end of the pole 112 is inserted into the opening 140, a bolt or other fastener is inserted through the matching holes 146 in the pole connecting portion 134 and also through matching holes (not shown) formed in the upper end of the pole 112 to secure the pole 112 to the mounting device 110.

As part of the installation procedure for this second embodiment, a second pair of openings 148 are drilled into the pole mounting portion 138 and also a matching second set of holes are drilled through the upper end of the pole 112. Then a fastener such as a bolt is inserted through this second pair of holes 148 and the second set of holes in the pole.

When the installation is completed, the mounting device 110 is fixedly connected to the pole 112, thus insuring that the angular position of the mounting structure 50*a* is correct. Also, the two rollers 138 and 140 are spaced from one another so that these engage the line 110 snugly.

The connecting means 52*a* interconnects the mounting structure 50*a* with the rear end of the connecting device 110, and it can be seen that there is an opening 150 drilled in a forward plate 152 of the device 110 to receive the bolt of the connecting means 52*a*. The connecting means 52*a* and the mounting structure 50*a* function as described in the text relating to the first embodiment.

Therefore, I claim:

1. A mounting system particularly adapted for mounting a radar unit to a boat, said system comprising:

a) a line connecting portion comprising first, second and third connecting lines, each having a first end and a second end, the first end of each line for connection to the boat at a respective one of three base connecting locations which are spaced from one another in a triangular configuration;

b) a mounting assembly comprising:

i) a connecting section that comprises first, second and third connecting portions for connection at first, second and third base connecting locations, which are spaced from one another in a corresponding triangular configuration, with the second ends of the first, second and third lines being connected to, respectively, the first, second and third connecting portions, in a manner that the three lines are in tension so as to locate the mounting assembly at a mounting location;

ii) a mounting section mounted to the connecting section and adapted to have the radar unit mounted thereto.

2. The system as recited in claim 1, wherein said connecting section comprises an interconnecting portion by which the connecting section connects to the mounting section in a manner to allow at least limited relative rotational movement between the connecting section and the mounting section so that the mounting section can remain in a desired angular position, whereby the radar unit mountable to the mounting section would be properly positioned.

3. The system as recited in claim 2, wherein the interconnecting portion rotates about an axis having a substantial horizontal alignment component, and the mounting section is located and configured, relative to location of the interconnecting portion, so that the radar unit mountable on the mounting section can be located sufficiently below the axis of rotation so that force of gravity tends to maintain the mounting section in said desired angular position.

4. The system as recited in claim 3, wherein said interconnecting portion comprises relatively rotating parts, and further comprises a tightening device to put said relatively rotating parts of the interconnect portion in greater or lesser frictional engagement to control rotational movement of the mounting section.

5. The system as recited in claim 2, wherein the interconnecting portion comprises at least on bearing member a first positioning member having a fixed angular orientation relative to said connecting section and a second positioning member having a fixed angular orientation relative to said mounting section, said first and second positioning members being in operative engagement to move relative to one another so as to have a fixed angular orientation relative to one another as the mounting section rotates relative to said connecting section to maintain proper angular orientation of said mounting section.

6. The system as recited in claim 5, wherein said second positioning member has a flat planar surface engaging said at least one bearing member of the interconnecting portion to maintain the proper angular orientation of the connecting section with the connecting portion and thus proper angular orientation relative to the mounting section.

7. The system as recited in claim 1, wherein said first, second and third connecting lines comprise a back stay of a sailboat, and said first line adaptable to extend from an upper location on said boat downwardly to said connecting section, and said connecting section connects to a lower end of said first line, and said second and third lines are attached by upper ends thereof to the connecting section and adapted to connect at laterally spaced locations at lower locations of the boat.

8. The system as recited in claim 7, wherein the first ends of the second and third lines are each connected to tensioning member by which the second and third lines can be tensioned.

9. A method of mounting a radar unit to a boat, said method comprising:

a) providing first, second and third connecting lines, each having a first end and second end, where the first end of each line is connected to a respective one of three base connecting locations which are on the boat and are spaced from one another in a triangular configuration;

b) connecting a connecting section to a mounting section to which the radar unit is mounted;

c) connecting the second ends of said first, second and third lines to first, second and third connecting locations of the connecting section, where the three connecting locations are spaced from one another in a triangular configuration;

d) tensioning the three lines to locate the connecting section, the mounting section and the radar unit at a mounting location.

10. The method as recited in claim 9, wherein an interconnecting portion is connected between the connecting section and the mounting section in a manner to allow at least limited relative rotational movement between the connecting section and the mounting section so that the mounting section can remain in a desired angular position, whereby a radar unit mounted to the mounting section would be properly positioned.

11. The method as recited in claim 10, wherein at least a portion of the interconnecting portion rotates about an axis having a substantial horizontal alignment component, and the mounting section is located and configured, relative to location of the interconnecting portion so that the radar unit on the mounting section is located sufficiently below the axis of rotation so that force of gravity tends to move the mounting section to a location to maintain said desired position.

12. The method as recited in claim 9, further comprising utilizing said first, second and third connecting lines as a back stay of a sailboat and said first line extends from an upper location on said boat downwardly to said connecting section, and said connecting section connects to a lower end of said first line, and said second and third lines are attached by upper ends thereof to the connecting section and connect at laterally spaced locations at lower locations of the boat.

13. The method as recited in claim 12, comprising tensioning the first ends of the second and third lines to cause the lines to become taut.

14. A mounting apparatus particularly adapted for mounting a radar unit to a boat at a mounting location where the boat has first, second and third connecting lines, each having a first end and a second end, the first end of each line being connectable to respective one of three boat connecting locations which are spaced from one another in a triangular configuration;

said apparatus comprising:

i) a connecting section that comprises first, second and third connecting portions for connection at first, second and third boat connecting locations, which are spaced from one another in a corresponding triangular configuration, with the second ends of the first, second and third connecting portions adapted to be connected to the second ends of, respectively, the first, second and third lines in a manner that with the three lines in tension the connecting section is at the mounting location;

ii) a mounting section arranged to have the radar unit mountable thereto, said mounting section being connected to the connecting section, to be positioned at the mounting location.

15. The apparatus as recited in claim 14, wherein said connecting section comprises an interconnecting portion by which the connecting section connects to the mounting section in a manner to allow at least limited relative rotational movement between the connecting section and the mounting section so that the mounting section can remain in a desired angular position, whereby the radar unit mountable to the mounting section would be properly positioned.

16. The apparatus as recited in claim 15, wherein the interconnecting portion rotates about an axis having a substantial horizontal alignment component, and the mounting section is located and configured, relative to location of the interconnecting portion so that the radar unit mountable on the mounting section can be located sufficiently below the axis of rotation so that force of gravity tends to maintain the mounting section said desired position.

17. The apparatus as recited in claim 15, wherein the interconnecting portion comprises at lease one bearing member, a first positioning member having a fixed angular orientation relative to said connecting section and a second positioning member having a fixed angular orientation relative to said mounting section, said first and second positioning members being in operative engagement to move relative to one another so as to have a fixed angular orientation relative to one another as the mounting section rotates relative to said connecting section to maintain proper angular orientation of said mounting section.

18. The apparatus as recited in claim 17, wherein said second positioning member has a flat planar surface engaging said at least one bearing member of the interconnecting portion to maintain the proper angular orientation of the connecting section with the mounting section.

19. The apparatus as recited in claim 17, wherein said interconnecting portion comprises relatively rotating parts, and further comprises a tightening device to put said relatively rotating parts the interconnecting portion in greater or lesser frictional engagement to control rotational movement of the mounting section.

* * * * *